United States Patent [19]

Khoury

[11] 4,202,750

[45] May 13, 1980

[54] CONTAINER ANODE

[75] Inventor: Nick S. Khoury, Worth, Ill.

[73] Assignee: The Continental Group, Inc., New York, N.Y.

[21] Appl. No.: 770,724

[22] Filed: Feb. 22, 1977

[51] Int. Cl.[2] ..... C23F 13/00

[52] U.S. Cl. ..... 204/197; 29/522 A; 113/116 FF; 204/148; 220/284; 220/456; 220/458

[58] Field of Search ..... 204/148, 197; 113/116 FF, 121 A, 121 C; 29/522; 220/272, 273, 456, 458

[56] References Cited

U.S. PATENT DOCUMENTS

| | | | |
|---|---|---|---|
| 571,380 | 11/1896 | Lisk | 204/197 |
| 902,758 | 11/1908 | Nielsen | 204/148 |
| 1,837,051 | 12/1931 | Kohman | 204/197 |
| 2,490,978 | 12/1949 | Osterheld | 204/197 |
| 2,619,455 | 11/1952 | Harris et al. | 204/197 |
| 2,732,021 | 1/1956 | Taft | 204/148 |
| 3,198,155 | 8/1965 | Fraze | 29/522 |
| 3,385,471 | 5/1968 | Dunn | 220/273 |
| 3,404,648 | 10/1968 | Rosbottom | 29/522 |
| 3,579,809 | 5/1971 | Wolf et al. | 113/116 FF |
| 3,629,091 | 12/1971 | George | 204/197 |
| 3,830,634 | 8/1974 | Zaremski et al. | 204/197 |
| 4,013,811 | 3/1977 | Maruska | 204/197 |

*Primary Examiner*—G. L. Kaplan

*Attorney, Agent, or Firm*—John J. Kowalik; Joseph E. Kerwin; Charles E. Brown

[57] ABSTRACT

A container having a rigid wall with a sacrificial anode non-removably attached to the inner surface thereof. Both the container wall and the anode are formed with nested integral rivets, whereby the anode is held in close contact with the container wall. Formation of the rivet on the container wall causes fracture of the protective enamel or lacquer coating thereon, and exposure of the underlying metal, whereby electrical contact between the anode and the container wall is established.

There is also disclosed a method or methods of achieving the attachment of the anode to the container wall in accordance with the present invention.

8 Claims, 11 Drawing Figures

CONTAINER ANODE

BACKGROUND

The present invention relates to metallic containers and, more particularly, to metal container having an anode for protection of the container and for prevention of undesired chemical reaction between the material of the container and the contents stored therein.

It has long been recognized that packaging of certain corrosive food-stuffs, notably ham in brine, in steel cans or containers, results in corrosion problems. Specifically, the brine solution attacks any exposed metal of the container, while contact between exposed metal and the ham results in discoloration of the meat.

Attempts to solve this problem have centered around provision of a protective inner coating on the container walls or provision of a sacrificial anode.

Reliance solely on a protective inner coating has proven unsuccessful in that such a coating must maintain absolute integrity to be effective. This integrity is generally destroyed during formation of this sideseam of a three piece can and/or during attachment of the bottom and top of the can to the container side wall. For this reason, greater reliance is currently placed upon provision of a sacrificial anode on the interior of the container.

Successful use of a sacrificial anode has been hampered by lack of a satisfactory means of attaching the anode to the container wall. Attempts at spot welding the anode to the wall have proven unsatisfactory in that the lacquer protective coating on the inner surface of the container wall interferes with a successful weld. It is therefore necessary to remove all lacquer in the area of the weld to insure a reliable attachment. This involves an unacceptable additional expense. Mechanical fastening of the anode to the container wall has also proven unsatisfactory in that the process tends to leave exposed metal on the container wall which is not covered by the anode. The exposed metal of the container may then come in contact with the product resulting in an undesirable discoloration thereof. Existing methods of anode attachment are further found to be unreliable, allowing separation of the anode from the container or loss of electrical contact between the anode and the container body during post-attachment handling.

SUMMARY OF THE INVENTION

It is the primary object of the present invention to provide a metallic container having attached to the interior surface thereof a sacrificial anode which prevents or alleviates the problems of product discoloration and corrosive attack on the container wall. More specifically, it is an object to provide a rigid container sidewall having an anode attached to the inner surface thereof in such manner as to provide good electrical contact between the container sidewall and the anode, and also to prevent contact between contents of the container and any metal exposed during attachment of the anode to the sidewall.

This is accomplished generally by forming integral nested rivets on both the container sidewall and the anode whereby the two elements are nonremovably attached while remaining imperforate. The formation of the rivets is performed in such manner as to fracture the protective enamel coatings on the container sidewall, such that the anode is placed in electrical contact with the metal of the container. The imperforate anode is arranged to cover the entire area of disturbed enamel, whereby contact between the contents of the container and the exposed metal of the container sidewall is prevented.

It is a further object of the present invention to provide a means of attaching the anode to the container while maximizing the use of existing tooling and equipment. This is accomplished by a tooling arrangement whereby a recess or "button" is first formed in the wall of the container. Simultaneously, or as a separate step, a mating protrusion is formed in the anode such that the two protrusions are nested one within the other. The protrusions are then simultaneously reformed such that nested integral rivets are created in the anode and container sidewall, non-removeably attaching the one to the other. The tooling is further arranged so as to maintain the anode in close contact with the wall of the container, and to prevent distortion of either member during the attachment process.

The previously described working of the container sidewall results in fracture of the protective enamel coating thereon and assures good electrical contact between the underlying metal thereof and the sacrificial anode. Due to the imperforate nature of the anode and its close contact to the container sidewall, there is assured protection of all exposed container sidewall metal and contact with the packaged solid product is thereby prevented.

BRIEF DESCRIPTION OF THE DRAWINGS

With the above and other objects in mind as may herein after appear, the invention may be more readily understood by reference to the following description and the accompanying drawings wherein.

DESCRIPTION OF THE PREFERRED EMBODIMENT

Figure 1:
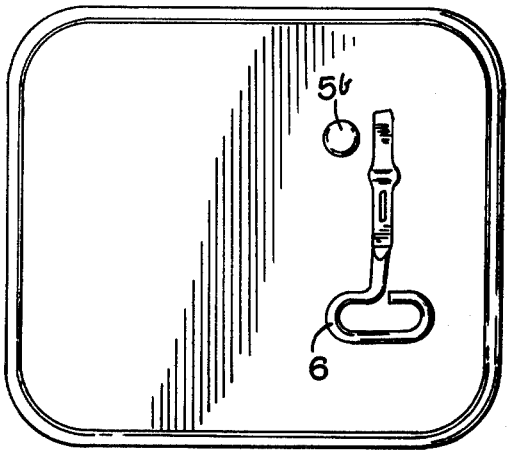
FIG. 1 is a top plan view of an end closure having an anode attached thereto in accord with the present invention.
Figure 2:
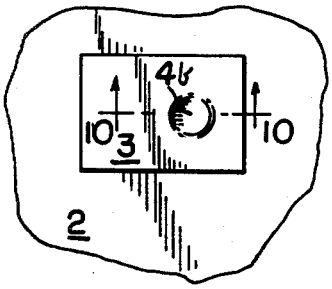
FIG. 2 is a fragmentary bottom plan view of the end closure of FIG. 1.

In keeping with the present invention, there is provided a metal can or similar container having a steel or tin-plated steel wall 1 bearing, on the inner surface thereof, a product-compatible protective coating 2 such as lacquer. A sheet metal sacrificial aluminum anode 3 is nonremovably attached to the inner surface of the container wall 1 by means of nested rivets 4 and 5 integrally formed in the anode 2 and the wall 1 respectively. As illustrated in FIGS. 1 and 2, the anode 3 is preferably attached to an end panel of the container, although attachment to a container sidewall is also contemplated by the present invention.

Cracks or fractures 2a in the protective coating 2 permit electrical contact between the anode 3 and the steel wall 1, the anode 3 being in covering relation to the entire fractured portion of the coating 2, whereby contact between product and the steel alloy of the wall 1 is prevented.

Figure 11:
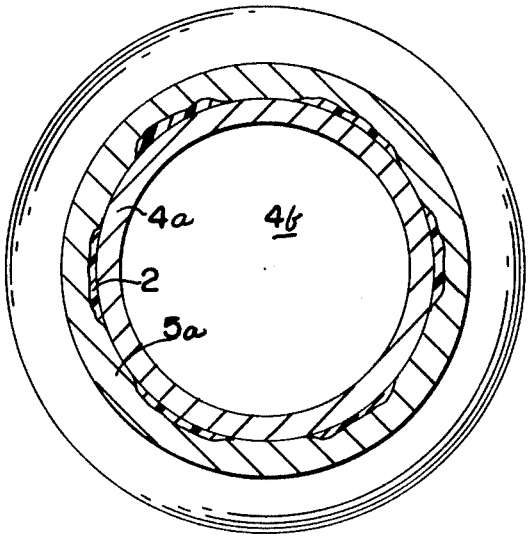
FIG. 11 is an enlarged fragmentary cross-sectional view taken substantially along line 11—11 of FIG. 10.
Figure 9:
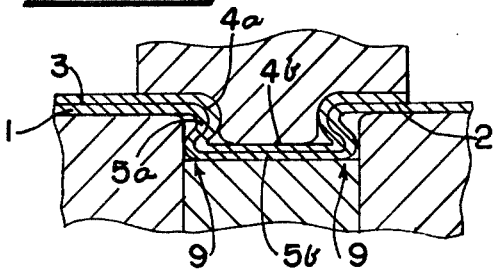
Figure 10:
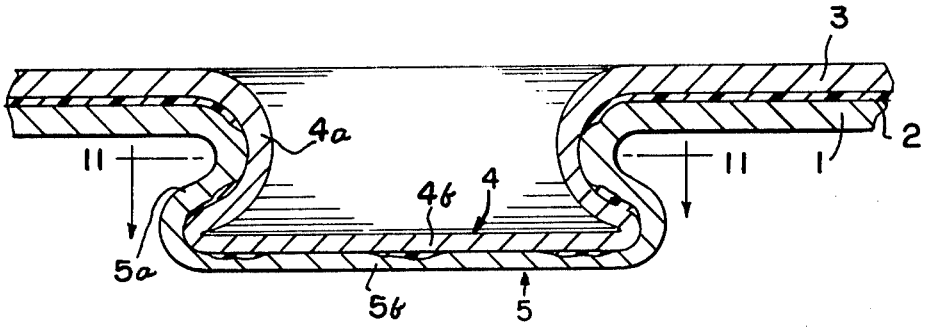
FIG. 10 is an enlarged fragmentary cross-sectional view of the rivet structure attaching the anode to the container wall portion.

As best seen in FIGS. 10 and 11, the rivets 4 and 5 each comprise a shank portion 4a, 5a, and an outwardly flanged head 4b, 5b. Both the wall 1 and the anode 3 are imperforate, whereby any possibility of container leakage is eliminated. The head 4b of the anode 3 is of larger dimension than the hollow shank 5a of the wall rivet 5, preventing separation of the rivets 4 and 5.

A container opening device or key 6 is attached to the outer surface of the container wall 1, proximate the rivet 5, by means known in the art, as, for example, spot welding. The anode 3 covers the portion of the protective coating 2 opposite the point of attachment of the opening device 6, shielding any steel alloy exposed through damage to the coating 2 during the attachment process.

In FIGS. 3 through 9, there is illustrated a method, and the tooling associated therewith, for attaching an anode 3 to a container wall 1 in accordance with the present invention.

Figure 3:
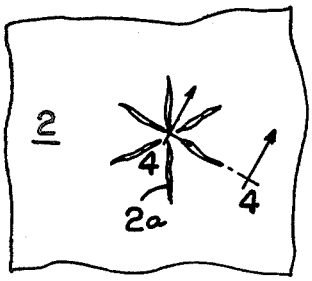
FIG. 3 is a fragmentary bottom plan view of the end panel of FIG. 1, prior to attachment of the anode thereto.
Figure 4:
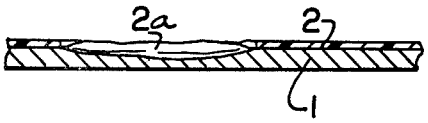
FIG. 4 is a fragmentary cross-sectional view taken substantially along line 4—4 of FIG. 3.

In FIG. 3, there is shown the inner surface of a portion of the container wall 1, having thereon a protective coating 2. The wall 1 has been struck with a burr wheel or similar rough-edged tool to produce a pattern of cracks or fractures 2a in the protective coating 2 exposing the underlying steel alloy. As seen in FIG. 4, the impact of the tool has displaced steel alloy upwardly so as to partially protrude through the fractures 2b in the protective coating 2. As will be explained more completely following, this step may be omitted, depending upon the physical characteristics of the particular material comprising the coating 2.

The anode 3 is attached to the wall portion 1 by forming nested protrusions 7 and 8 respectively therein and then reforming the nested protrusions 7 and 8 to form the interlocked rivets 4 and 5.

Figure 5:
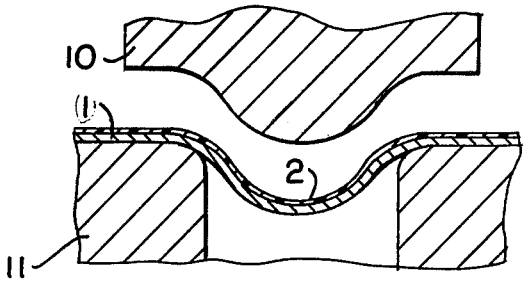
FIGS. 5–9 are fragmentary cross-sectional views illustrating methods of attaching an anode to a container wall portion.
Figure 7:
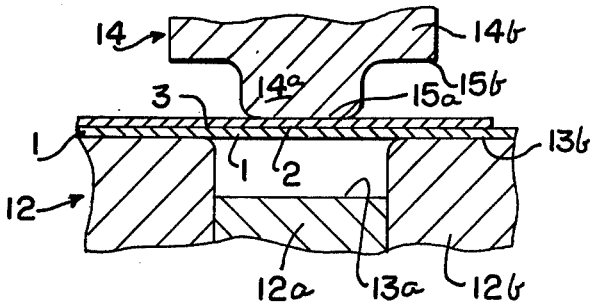

Formation of the rivets 4 and 5 may proceed from the superposition of a substantially planar anode 3 over a similar wall portion 1, as illustrated in FIG. 7, or the wall portion 1 may be preformed with a "bubble" or "dimple" as shown in FIG. 5. In the latter case, the "dimple" in the steel alloy wall 1, which is formed using a conventional punch 10 and anvil 11, serves as a female die for the softer aluminum anode 3 during formation of the nested rivets 4 and 5.

Figure 6:
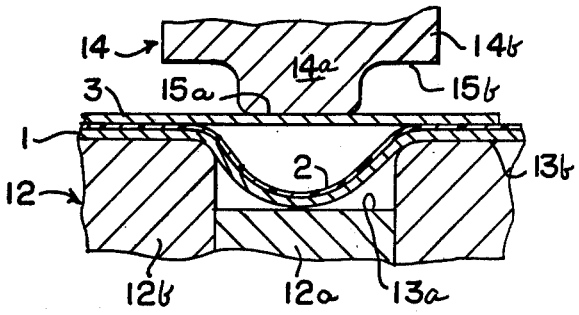

As shown in FIGS. 6 and 7, the anode 3 is superposed over a wall portion 1, either with or without a preformed "dimple", and positioned on a spring-loaded anvil 12 with the protective coating 2 toward the anode 3. The anvil 12 comprises a central portion 12a and an annular portion 12b adapted for axial displacement, relative thereto. The anvil portions 12a and 12b include planar parallel tool faces 13a and 13b respectively.

A punch 14 is provided, in cooperating relation to the anvil 12, comprising a relatively fixed central portion 14a and annular portion 14b. The punch portions 14a and 14b include planar parallel tool faces 15a and 15b respectively, face 15a being offset from the plane of the face 15b toward the anvil 12 and parallel thereto. Likewise, the anvil face 13a is offset from the plane of the face 13b away from the punch 14. The central portion 14a of the punch 14 is of a size to freely enter into the recess provided in the anvil 12 by the offset anvil central portion 12a.

Figure 8:
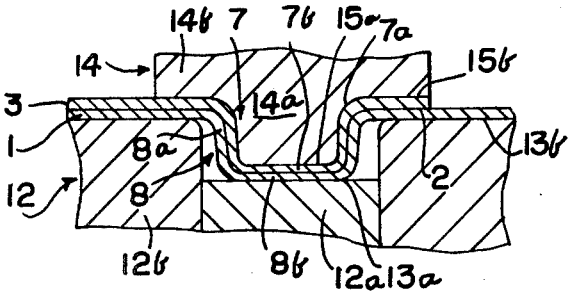

As the punch 14 is advanced toward the anvil 12, the offset central portion 14a thereof engages the anode 3 and the underlying wall portion, and forms therein nested protrusions 7 and 8 as best seen in FIG. 8, each comprising a sidewall 7a, 8a and a transverse wall 7b, 8b.

As the punch 14 continues to advance, the transverse walls 7b and 8b are compressed, between the faces 15a and 13a of the punch 14 and the anvil 12, resulting in thinning thereof. The displaced metal of the wall 1 and the anode 3 is extruded radially outwardly from the center of the protrusions 7 and 8 and forms annular flanges 9 about the transverse walls 7b and 8b. The protrusions 7 and 8 have now been reformed into the rivets 4 and 5, with the flanged transverse walls 7b and 8b comprising the rivet heads 4b and 5b. It is thus seen that the clearance between the central portion 14a of the punch 14 and the annular portion 12b of the anvil 12 controls the formation of the rivet heads 4a and 5a, with the proper clearance being chiefly dependent upon the thickness of material of the wall 1 and anode 3.

During the course of the rivet formation, there is a tendency to rupture or fracture the protective coating 2 at the base of the protrusion 8. If the steel exposure thus achieved is sufficient, the prior fracturing of the coating 2 as previously described, may be omitted.

During the rivet formation process, the portions of the anode 3 and the wall 1, adjacent the rivets 4 and 5, are compressed between the annular portion 14b of the punch 14 and the spring-loaded annular portion 12b of the anvil 12. A very close fit is thus established between the anode 3 and the container wall 1, preventing product entry therebetween. The possibility of contact between the product and exposed steel is thereby eliminated.

Although the method as described above yields rivets 4 and 5 projecting outwardly of the container, it is to be understood that reversal of the punch 14 and anvil 12 to yield inwardly projecting rivets 4 and 5 is also within the intended scope of the present invention.

I claim:

1. An article of manufacture comprising a container for a product likely to be deteriorated due to galvanic action, said container having a ferrous alloy wall with an inner surface having a protective coating thereon, an area on said wall having fractures in said coating, a sacrificial anode of sheet metal attached to said inner surface of said container wall at said fractured area, both said container wall and said anode being imperforate, said container wall and said anode each being formed with at least one protrusion, said anode having a portion circumjacent to said protrusion positioned in close opposition to said coating on said container wall and said protrusions having interlockingly nested leak tight overlapped portions formed in situ, said overlapped portion of said anode extending through said fractures and establishing electrical conductivity contacts through the fractures in said coating and said contacts being isolated from the interior of the container wall to prevent exposure of the underlying ferrous alloy to the product.

2. The container of claim 1, wherein said anode is formed of an aluminum alloy.

3. The container of claim 1 and a container opening device attached to the outer surface of said container wall, said anode being in covering relation to the portion of said protective coating opposite the point of attachment of said opening device.

4. The container of claim 1, wherein each of said projections is in the form of an integrally formed hollow rivet, and the head of the rivet being on the external side of the wall.

5. The invention according to claim 1 and said coating forming a seal between said nested portions of said rivets.

6. A can or similar metal container comprising a ferrous alloy wall having a protective coating on the surface thereof toward the contents of said container, a portion of said coating being formed with fissures exposing said metal, and a sacrificial anode in the interior of said container, said anode being attached to said wall at said portion by means of nested rivets integrally formed in each of said anode and said wall, and said rivet of the anode being pressed through said fissures into electrical contact with said wall, both said anode and said wall being imperforate and said rivets having a sealing fluid tight fit with each other in a region between the interior of the can and the area of electrical contact and said anode having a portion of extensive area shielding said region of electrical contact to prevent direct product exposure thereto.

7. A method of attaching a sacrificial anode of sheet material to a wall portion of a can or similar metal container having a protective coating of product-compatible material on the inside surface thereof, comprising the steps of:

providing an anode of sheet material, pre-fracturing said coating in a predetermined area by impacting against the coating to form fractures thereby exposing the metal therebeneath, forming at least one protrusion in each of said wall portions and said anode in said fractured area of the coating while nesting the protrusions of said anode and said wall portion and reforming aid nested protrusions to form interlocked rivets and expanding the anode rivet through the fractures and thereby establishing electrical conductivity therebetween and said anode being dimensioned and positioned to completely shield the region of electrical conductivity from direct contact with product adapted to be placed within the can.

8. The invention according to claim 7 and said wall portion being displaced at said fractures to protrude through the fractures.

* * * * *